US005725299A

United States Patent [19]

Devorris

[11] Patent Number: 5,725,299

[45] Date of Patent: Mar. 10, 1998

[54] ENCAPSULATED CHARGED GAS LIGHTING APPARATUS

[76] Inventor: Philip E. Devorris, 305 Fairways, Hollidaysburg, Pa. 16648

[21] Appl. No.: 587,347

[22] Filed: Jan. 16, 1996

[51] Int. Cl.[6] ..... F21S 3/00

[52] U.S. Cl. ..... 362/216; 362/145; 362/223; 362/224; 362/263; 362/362; 362/367; 362/368

[58] Field of Search ..... 362/216, 219, 362/220, 221, 223, 224, 267, 268, 310, 367, 368, 333, 145, 151, 152, 263

[56] References Cited

U.S. PATENT DOCUMENTS

| | | | |
|---|---|---|---|
| 1,817,543 | 8/1931 | Ciraolo | 362/263 |
| 1,993,943 | 3/1935 | Nunez | 40/545 |
| 2,175,155 | 10/1939 | Miller et al. | 362/263 |
| 2,238,589 | 4/1941 | Hensler | 362/263 |
| 2,532,023 | 11/1950 | Guth | 362/220 |
| 2,562,740 | 7/1951 | Rizer . | |
| 3,544,782 | 12/1970 | Hahn | 362/222 |
| 3,550,298 | 12/1970 | O'Neill . | |
| 3,673,402 | 6/1972 | Weiss | 362/220 |
| 4,039,894 | 8/1977 | Gardner, III | 315/76 |
| 4,064,430 | 12/1977 | Owens | 362/231 |
| 4,283,758 | 8/1981 | Irving | 362/251 |
| 4,413,311 | 11/1983 | Orenstein | 362/223 |
| 4,569,004 | 2/1986 | Peterson | 362/216 |
| 4,703,574 | 11/1987 | Garjian | 40/545 |
| 4,947,301 | 8/1990 | Steele | 362/219 |
| 4,977,490 | 12/1990 | Davies | 362/221 |
| 4,991,070 | 2/1991 | Stob | 362/223 |
| 4,998,365 | 3/1991 | Bezak | 40/545 |
| 5,008,787 | 4/1991 | Sklar et al. | 362/221 |
| 5,040,104 | 8/1991 | Huisingh et al. | 362/333 |
| 5,142,466 | 8/1992 | Foster et al. | 362/224 |
| 5,150,961 | 9/1992 | Gonzalez | 362/83.2 |
| 5,192,125 | 3/1993 | Gonzalez | 362/83.2 |
| 5,197,797 | 3/1993 | Jaksich | 362/223 |
| 5,209,674 | 5/1993 | Foster et al. | 362/263 |
| 5,339,230 | 8/1994 | Devorris | 362/216 |
| 5,348,413 | 9/1994 | Sklar | 362/263 |
| 5,386,353 | 1/1995 | Battaglia | 362/224 |
| 5,436,813 | 7/1995 | Gonzalez | 362/263 |
| 5,453,917 | 9/1995 | Ogawa | 362/368 |
| 5,541,823 | 7/1996 | Fallon et al. | 362/219 |
| 5,550,724 | 8/1996 | Moulton | 6362/217 |

FOREIGN PATENT DOCUMENTS

| | | |
|---|---|---|
| 69.25618 | 4/1971 | France . |
| 1204372 | 9/1970 | United Kingdom . |

OTHER PUBLICATIONS

Advertisement: RNR Technologies, Inc. for NEOSTIX (Decorative Lighting Apparatus).

Photographs: Lighting Apparatus manufactured by Fallon Luminous Products Corp.

*Primary Examiner*—Ira S. Lazarus
*Assistant Examiner*—Matthew Spark
*Attorney, Agent, or Firm*—Pennie & Edmonds LLP

[57] ABSTRACT

A lighting apparatus comprising an elongated tubular housing for closely receiving therein a charged gas lighting source, such as, a neon lighting assembly. A power source is connected to the lighting source by electric power cords. The lighting source includes at least one elongated glass tube containing a neon gas mixture having both ends of the tube bent back along itself such that the ends are secured within the housing. An adjustable length extension lighting assembly allows for any overall length of continuous lineal lighting. The housing can be comprised of a base and cover member slidingly received within the base, thereby forming a central opening therebetween for receiving therein the lighting source, wherein the side walls of the base and cover member substantially overlap for preventing electricity from passing therethrough. A bracket is used to hold the lighting apparatus in place, and can be used to facilitate the mounting of the apparatus. Several lighting apparatuses can be mounted in longitudinal alignment to form a continuous lineal lighting source. When so mounted, a connecting or sealing means is used to protect the light source and/or prevent the ingress of precipitation. The housing can be adapted to produce colored light. The housing can also be adapted so that the electric power cords and the connection of those cords to the charged gas lighting source are not clearly visible.

12 Claims, 5 Drawing Sheets

ENCAPSULATED CHARGED GAS LIGHTING APPARATUS

TECHNICAL FIELD

The present invention generally relates to charged gas lighting instruments, such as neon lighting devices.

BACKGROUND OF THE INVENTION

Well known examples of charged gas lighting instruments include neon-lighted beer signs for small-scale indoor application. Also well known are large-scale outdoor applications such as neon-lighted billboards and neon accent lighting for commercial buildings. Most often these types of charged gas lighting instruments utilize glass lighting tubes. The tubes are filled with an assortment of light-emissive gas mixtures which often include neon gas. Depending on the mixtures, or the phosphorous coatings applied to the inside surface of the glass tubes, different colors of brightly glowing light, commonly referred to as "neon light," can be created when the gases contained in the glass tubes are subjected to an electrical discharge.

With most commercial neon lighting (e.g., beer signs, billboards and building accents), the unprotected glass tubes are secured to a frame, or in some cases, directly to the facade of a building for display. However, the fragile tubes are highly susceptible to breaking. Indeed, quite often the tubes are damaged during shipping or installation procedures. Moreover, it is exceptionally difficult to reuse or relocate the tubes once they have been installed. When used outdoors, exposed tubes and their respective electrical fittings are extremely vulnerable to the outside elements. In addition, a charged gas lighting device, such as a neon light, utilizes a high voltage power source (e.g., 10,000 volts), and is therefore relatively dangerous. These devices should be installed and maintained only by a professional electric sign installer.

Various methods of protecting the glass tubes and electrical fittings are known in the art. They include U.S. Pat. No. 4,947,301 to Steele describing a non-conductive housing for sheltering the electrode ends and high voltage conductors of a neon-filled glass tube; and U.S. Pat. Nos. 5,150,961 and 5,192,125 to Gonzalez describing apparatuses for illuminating a vehicle license plate including an annular neon-filled glass tube mounted within a front transparent channel member and a rear protective cover plate.

There are various drawbacks, however, with these conventional devices. In particular, the apparatus as described in Steele mounts the neon-filled glass tube to the housing exterior thereby exposing the fragile tube to the outside elements and greatly increasing the likelihood that the unprotected tube will be prematurely broken. The broken glass, or high voltage current from the wires attached to a damaged tube, poses a serious injury risk.

Even other devices which locate the glass tube within a housing do not eliminate the risk of high voltage shock. For instance, the devices as described in the Gonzalez patents enclose the neon-filled glass tube within a front transparent channel member and a rear protective cover plate. Although this protects an individual from accidentally touching the high voltage electrical connections of the neon-filled glass tube, the front and back covers create a seam through which a high voltage current may pass. That is, it is possible for electric current to arc from the electrical fittings through the housing's seam. It is even more likely to occur if a conductive apparatus, like a metal screwdriver, is placed at or near the seam which is likely to occur during installation or maintenance procedures. In addition, electricity which arcs through a seam in the housing presents a serious fire hazard.

Also known in the art is U.S. Pat. No. 2,562,740 to Rizer describing a tubular florescent element covered by flexible plastic tubing also for illuminating a license plate. The flexible tube, however, would do little to protect the glass tube from breaking upon a heavy impact, or insulate the electrical connections from delivering an electric shock. Accordingly, there was a need for an improved, compact lighting device which could protect a glass lighting tube from breaking or damage and minimize the possibility of electric shock.

These needs were met by the Encapsulated Charged Gas Light Apparatus disclosed in U.S. Pat. No. 5,339,230 to Devorris. The invention comprises an elongated tubular housing, made of a dielectric material, a charged gas light source snugly received within the housing, and at least one conducting element, such as, a power cord passing through an endcap removably secured to the housing. Now, several new ideas related to this invention are described herein.

Often the space to be filled by a series of lighting instruments is longer than an exact multiple of standard-length lighting instruments. Therefore, a need exists for an adjustable-length charged gas lighting instrument that can be easily adapted at the installation site to fit a space which is a different length than an exact multiple of standard lighting instruments, while still satisfying UL safety standards.

When placing multiple lighting devices end-to-end to create a continuous lighting effect (which also permits power cords to freely extend between multiple housings) it is desirable to connect, or seal from the ingress of precipitation or the outside elements, the two or more adjacent housings.

In most cases, the lighting instruments are mounted for display or aesthetic purposes. In such circumstances, it is desirable to conceal the conducting elements and electrical fittings of a neon lighting device without impeding the light emitted from the light source to pass through the front of the housing. Moreover, in such circumstances, it is desirable and often required that each lighting device emit a predetermined color of light. Although different mixtures of light-emissive gases or different phosphorous coatings on the inside surface of the glass neon tubes can be used to achieve the desired effect, a need exists for an easier, more efficient and less costly method of achieving the same results. Thus, a need exists for a housing fabricated from a colored material, wherein the finished housing is substantially transparent or translucent and emits a light of a predetermined color.

When installing neon lighting devices, for example to the facade of a building, it is often difficult to hold a lighting device in place while securing it to the building. This task becomes especially difficult and dangerous when the installer must hold several lighting units while atop a ladder or other apparatus high above the ground. Therefore, a need exists for facilitating the installation of neon lighting devices.

SUMMARY OF THE INVENTION

In light of the aforementioned needs, it is a particular objective of this invention to provide a means for adjusting the length of one or multiple adjacent neon lighting devices. To achieve this objective the present invention comprises an elongated tubular housing having at least one open end, a charged gas lighting source configured and dimensioned to be closely received within the tubular housing, at least one conducting element, such as a power cord, which connects to the lighting source at a point inside the housing, and means for adjusting the length of the lighting apparatus. In particular, the means for adjusting the length of the lighting apparatus comprises an adjacent elongated tubular housing, a charged gas lighting source configured and dimensioned to be closely received within the adjacent housing and extending into the first housing, a conducting element for connecting the light source to a power source, and a sleeve adapted to slideably and closely receive therein the open ends of the housings.

It is a further object of the present invention to connect, or seal from the ingress of precipitation or the outside elements, two or more adjacent housings. To achieve this objective the present invention provides means for connecting or sealing adjacent housings. In particular, the means for connecting or sealing comprises an elongated tubular member having open ends dimensioned and configured for slideably receiving therein open ends of adjacent housing members.

It is a further object of the present invention to conceal from view the conducting elements and electrical connections of a neon lighting device. To achieve this objective the present invention provides means for diffusing light emitted from the housing. The diffusing means comprises a substantially translucent material used to form the housing, or grooves formed on the surface of the housing.

It is a further object of the present invention to produce different colors of neon light. To achieve this objective the present invention comprises a housing made from colored material.

It is a further object of the present invention to facilitate the installation of neon lighting devices. To achieve this objective the present invention comprises a tubular member having open ends dimensioned and configured for slideably and closely receiving therein the housing member of a neon lighting apparatus. In furtherance of this objective, the tubular member can have off-set holes for independently receiving a screw or bolt therethrough.

The objectives described above are in addition to maintaining the safety and protective benefits associated with the Encapsulated Charged Gas Light Apparatus previously disclosed.

DETAILED DESCRIPTION OF THE PREFERRED EMBODIMENT

UL (United Laboratories) safety standards require devices utilizing high voltages (e.g. 10,000 volts), such as neon lighting devices, to have at least a 1–2 inch space between all electrical connections and any openings or seams in the housing depending on the voltage. This prevents the possibility of electricity arcing from the electrical connections through a seam in the housing wall and delivering an electric shock or causing an electrical fire.

Figure 1:
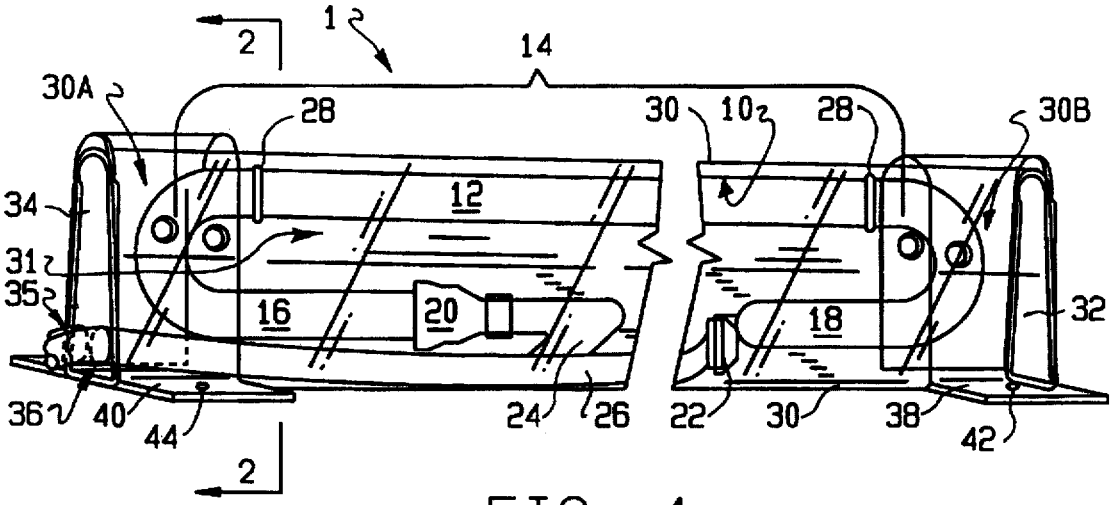
FIG. 1 Prior Art
FIG. 1 is an overall perspective view of the Encapsulated Charged Gas Lighting Apparatus described in U.S. Pat. No. 5,339,230 to Devorris.

Referring to FIG. 1, charged gas lighting apparatus 1 meets such industry safety standards. Charged gas lighting apparatus 1 includes protective housing 30. Protective housing 30 is a one-piece, substantially rigid encasing having a central opening 31 for closely receiving therein charged gas lighting source 10, such that the movement of charged gas lighting source 10 is severely constrained and the cross-sectional profile of housing 30 is effectively minimized. Housing 30 is made of a plastic or polymeric material that is preferably dielectrically sound for the high voltages required for charged gas lighting operations, thus preventing any possibility of electricity passing directly through the housing wall. A preferred example of such a dielectric polymer is LEXAN 953A, having a wall thickness of approximately one-eighth of an inch, which is manufactured and sold by the General Electric Company.

Mounted within housing 30 is charged gas lighting source 10 which includes a single glass tube 12. Glass tube 12 contains a light emissive gas, such as, neon. Neon or argon are common examples of light emissive gases which "glow"

or produce light when subjected to an electrical discharge. Usually, neon or a gaseous mixture containing neon is preferred for commercial use.

Glass tube 12 includes end portions 16 and 18 which are bent back along the tube (i.e, to the rear and center of the tube) substantially parallel to the wall of housing 30. This secures electrical connections 20 and 22 at the sealed ends of tube 12 sufficiently within housing 30 thereby preventing electricity from arcing through the open ends of the housing, and keeping someone from accidentally touching the electrical connections. The ends of tube 12 may be substantially adjacent to each other near the midpoint of housing 30, although this is not necessary, nor preferred for longer charged gas lighting apparatuses 1. In order to satisfy UL safety standards, as described above, electrical connections 20 and 22 should be secured within housing 30 at least 1–2 inches from open ends 30A and 30B. Accordingly, lighting apparatus 1 is safe for indoor and outdoor use, and can be installed by a person unfamiliar with this type of lighting, which eliminates the need for installation and wiring by a professional electric sign installer.

Housing 30 also protects glass tube 12 and electrical connections 20 and 22 from the outside elements, such as hail stones that would destroy the fragile glass tube, or precipitation that could prematurely corrode the electrical connections. Moreover, housing 30 safeguards glass tube 12 from contact with other objects that could destroy an exposed glass tube, which is a commonly occurring problem during shipment, transportation and installation. As a result, housing 30 reduces damage to, or wastage of the final product.

Figure 5:
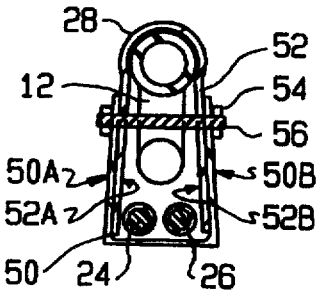
FIG. 5 Prior Art
FIG. 5 is a cross-sectional view of the charged gas lighting apparatus of U.S. Pat. No. 5,339,230 to Devorris showing a two-part housing having overlapping side walls.

Referring to FIG. 5, it is further contemplated that housing 30 can be made in two parts. Housing base 50 is configured to slidingly receive therein cover member 52 whereby side walls 50A and 50B of housing base 50, and side walls 52A and 52B of cover member 52 substantially overlap to prevent electricity from arcing through the seam created between the housing base and cover member. To satisfy UL safety standards, the side walls of the base and cover member overlap by at least 1–2 inches. A two-part housing allows for a shaped glass lighting tube 12 to be secured between housing base 50 and cover member 52. Alternatively, housing base 50 can be received within cover member 52 without departing from the scope of the present invention.

Housing base 50 and cover member 52 can be secured together by a nut 54 and bolt 56 assembly made of non-conductive material, wherein bolt 56 passes through side walls 50A, 52A, 52B and 50B, respectively. Alternatively, housing base 50 and cover member 52 may be secured together by other means, such as plastic welding or by use of an adhesive without departing from the scope of the present invention. For convenience, a securing means which can be re-used is advantageous for maintenance or repair purposes.

Figure 4:
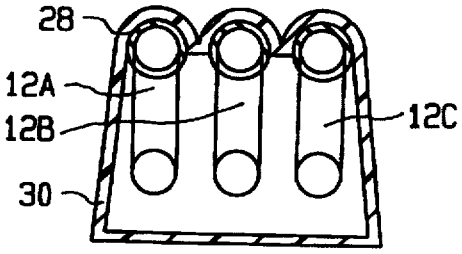
FIG. 4 Prior Art
FIG. 4 is a cross-sectional view of the charged gas lighting apparatus of U.S. Pat. No. 5,339,230 to Devorris having multiple lighting tubes.

Charged gas lighting source 10 includes a single glass tube 12, although as shown in FIG. 4, a plurality of glass tubes 12A, 12B and 12C can be incorporated into a single housing 30. In addition, it is contemplated that the inventions and improvements described herein are equally applicable for lighting apparatuses having a plurality of glass tubes or other elements.

Normally, the ends of a charged gas lighting tube are not as brightly lit as the center portion of the tube. Referring again to FIG. 1, ends 16 and 18 of glass tube 12 are angled approximately 180° to the rear and center of the tube thus creating elongated center portion 14. During operation the fully lit center portion 14 of tube 12 fills the entire length of transparent housing 30. Therefore, successive charged gas lighting devices 1 can be placed end-to-end to form a "continuous" lighting effect—i.e., one that does not show noticeable gaps between successive lighting devices.

Figure 2:
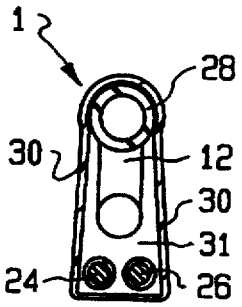
FIG. 2 Prior Art
FIG. 2 is a cross-sectional view of the charged gas lighting apparatus of the Encapsulated Charged Gas Lighting Apparatus described in U.S. Pat. No. 5,339,230 to Devorris taken along line 2—2 of FIG. 1.

Positioned along the length of tube 12 are a number of retainers 28 (also shown in FIG. 2) which minimize the movement of tube 12 within housing 30 and protect tube 12 from coming into contact with the inner wall of housing 30 and possibly breaking. Preferably, these retainers 28 are rubber O-rings, with a curvature that is commensurate with the curvature of the inside wall of housing 30, thereby firmly securing tube 12 (and more generally, charged gas lighting source 10) therein. Other non-conductive materials, such as plastic, can also be used.

Figure 7:
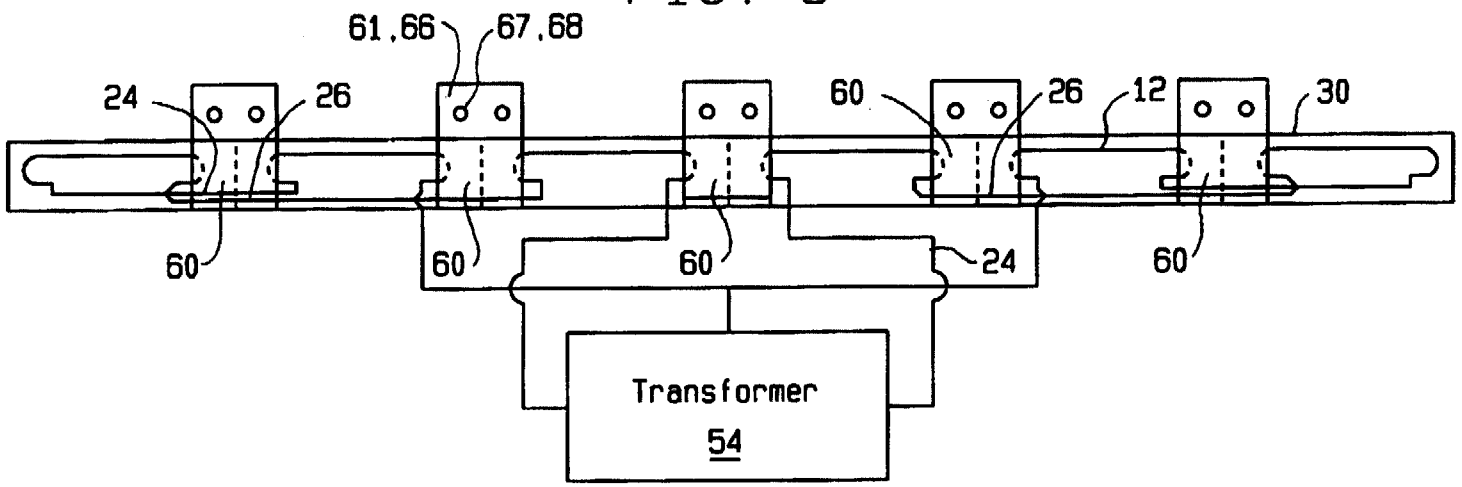
FIG. 7 is an electrical schematic view of several of the charged gas lighting apparatuses of the present invention.

In FIG. 1, glass tube 12 is connected to a power source (e.g., a transformer, not shown) or a successive charged gas lighting apparatus 1, by electrical conductors 24 and 26 which are attached to the ends of tube 12 at electrical connections 20 and 22. Referring to FIG. 7, there is shown an electrical schematic showing six charged gas lighting devices 1 each having a housing 30 and a glass tube 12 connected by brackets 60. Each charged gas lighting device 1 is connected by power cords 24 and 26 to either another charged gas lighting apparatus 1 or transformer 54. Electrical conductors 24 and 26 are preferably covered electrical power cords, however, any suitable electrical conductor can be used. The power source provides an electrical discharge which passes through the light emissive gas contained in glass tubes 12 thereby causing the gas to "glow" and emit light.

Power cords 24 and 26 are fitted with electrical plug ends (not shown), or other means for facilitating connection or disconnection of each charged gas lighting apparatus 1 with a power source or a successive charged gas lighting apparatus having appropriate electrical fittings for receiving the plug ends. As such, charged gas lighting apparatus 1 can be quickly and efficiently relocated with substantially no rewiring and little, if any, professional assistance required. Power cords 24 and 26 can exit housing 30 at any location, such as, through the side openings or a hole created at the back end of housing 30.

Figure 3:
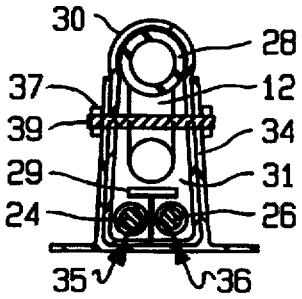
FIG. 3 Prior Art
FIG. 3 is an end view of the charged gas lighting apparatus of U.S. Pat. No. 5,339,230 to Devorris showing the electrical power line cords passing through an aperture in the end cap and an element for reflecting light towards the front of the housing.

Referring to FIG. 3, housing 30 is transparent and allows light to emit in all directions. If desired, a mirror 29 or other reflective material, such as reflective paint, may be secured to the rear of housing 30 for reflecting a substantial portion of the light emitted from tube 12 towards the front portion of housing 30. Also, it is contemplated that housing 30 may be made of a translucent material for achieving a different lighting effect.

Referring to FIG. 1, an alternative embodiment of housing 30 allows different colors of light to be emitted from charged gas lighting apparatus 1. For example, housing 30 can be manufactured of a colored material to cause charged gas lighting apparatus 1 to emit a predetermined color of light when using a tube 12 filled with a standard mixture of emissive gases.

As previously described, housing 30 of charged gas lighting instrument 1 can be manufactured either of transparent or translucent material. A housing manufactured completely of transparent material, however, allows the power cords and electrical connections to be visible which may detract from the aesthetic appeal of the lighting apparatus. Alternatively, a housing manufactured completely of translucent material may prevent some of the desired light from escaping from the housing. Thus, a need exists for hiding, obscuring or diffusing the view of the power cords and electrical connections contained within the housing, while allowing a portion of light to escape from the housing.

Figure 11:
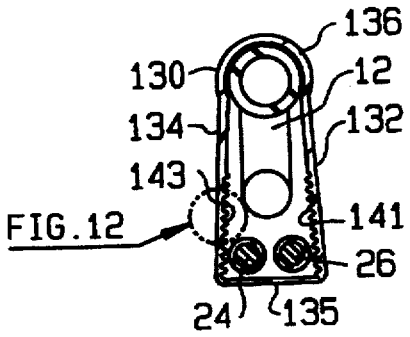
FIG. 11 is a cross-sectional view of the housing of the charged gas lighting apparatus of the present invention.

Referring to FIG. 1, housing 30 can be fabricated to substantially hide electrical connections 20 and 22, and power cords 24 and 26 from view while allowing substantially all of the desired light emitted from tube 12 to escape through the front of housing 30. Referring to FIG. 11, housing 130 includes a U-shaped front wall 136 and a planar back wall 135. Front wall 136 and back wall 135 are connected by side walls 132 and 134. Side walls 132 and 134 have on the rearward portion of their interior surface grooves 141 and 143, respectively. Grooves 141 and 143 diffuse the light emitted from glass tube 12 contained within housing 30 and therefore conceal the view of power cords 24 and 26 and electrical connections 20 and 22 (not shown). It is contemplated that grooves 141 and 143 can be formed on the exterior surface of housing 130, or elsewhere, and positioned other than at the rearward portion of housing 130, without departing from the scope of the invention.

Figure 12:
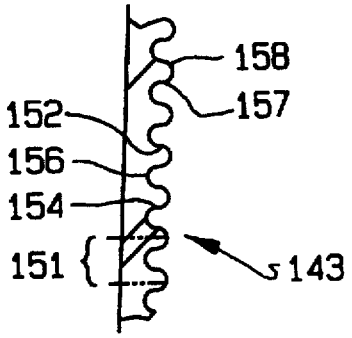
FIG. 12 is an enlarged cross-sectional view of the grooved surface of the back portion of the top and bottom walls of the housing of the charged gas lighting apparatus of the present invention.

FIG. 12 shows an enlarged view of the preferred embodiment of grooves 141 and 143 of housing 30. Each groove 151 has a front side wall 152, a rear side wall 154, a valley 156, a front peak 157, and a rear peak 158. Preferably, each groove 151 measures about 0.015 inches from front peak 157 or rear peak 158 to valley 156, and peaks 157 and 158 and valley 156 are rounded with a radius of about 0.010 inches. It is also contemplated, however, that there are many variations in groove size and shape, and methods to conceal or blur the view of the electrical conductors and fittings, without departing from the scope of the present invention.

Figure 13:
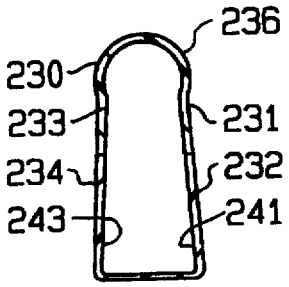
FIG. 13 is a cross-sectional view of an alternative embodiment of the housing manufactured using a co-extrusion process.

For example, as shown in FIG. 13, housing 230 is manufactured (by a co-extrusion process) similar to housing 30 as shown in FIG. 11. However, the rearward portions 241 and 243 of side walls 232 and 234 are manufactured of a substantially translucent or opaque material, instead of being grooved as previously described. A substantially transparent material is used for forming the forward portions 231 and 233 of side walls 232 and 234 and front wall 236. Thus housing 230 conceals electrical connections 20 and 22 and power cords 24 and 26 (not shown), while still permitting substantially all of the light emitted from glass tube 12 (not shown) through front wall 236.

Figure 15:
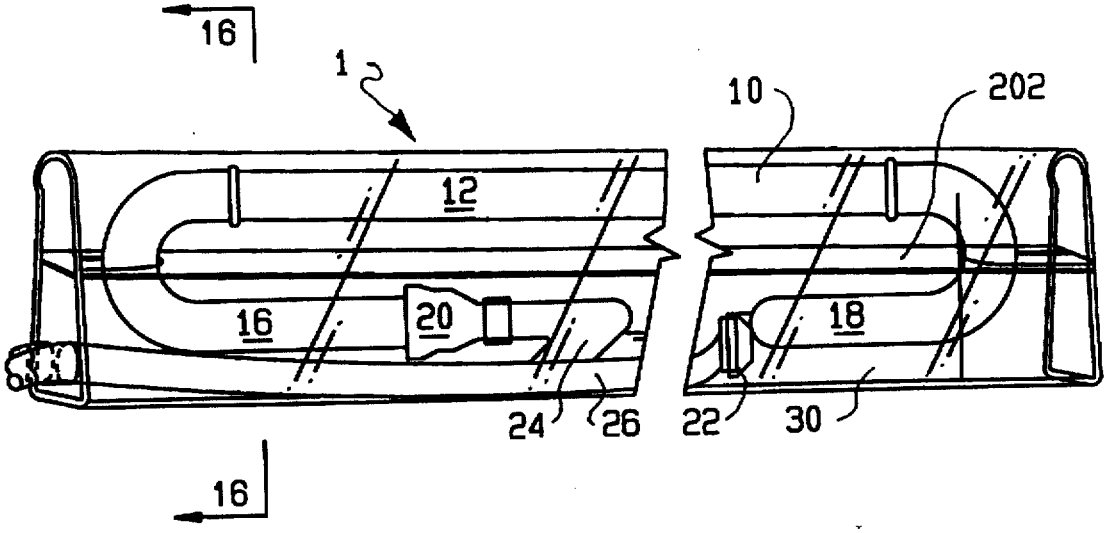
FIG. 15 is a perspective view of an alternative embodiment of the charged gas lighting apparatus of the present invention showing a view blocker.
Figure 16:
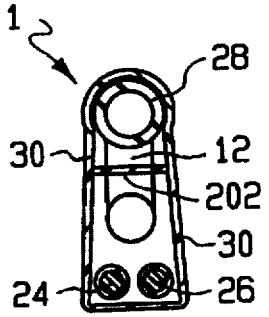
FIG. 16 is a cross-sectional view of an alternative embodiment the charged gas lighting apparatus of the present invention showing a view blocker and taken along line 16—16 of FIG. 15.

Referring to FIGS. 15 and 16, a further embodiment of the present invention is shown which comprises a view blocker 202 to conceal the view of electrical connections 20 and 22 and power cords 24 and 26. View blocker 202 is an opaque or translucent rectangular plate that is mounted within housing 30 between ends 30A and 30B of housing 30 with cut-outs provided around ends 16 and 18 of glass tube 12.

Referring again to FIG. 1, housing 30 is approximately the same length as elongated center portion 14 of glass tube 12. This allows center portion 14 to fill the entire length of housing 30 which not only permits a user to create a "continuous" lighting effect between successive charged gas lighting apparatuses 1, but also prevents movement of charged gas lighting source 10 within housing 30 once endcaps 32 and 34 are secured thereon.

Because a 1–2 inch space between the inside wall of housing 30 and electrical connections 20 and 22 is not necessary, housing 30 also is dimensioned to closely receive therein the cross-sectional profile of charged gas lighting source 10. This includes glass tube 12, glass tube end portions 16 and 18, electrical connections 20 and 22, power cords 24 and 26, and any other necessary electrical fittings and wires. Similarly, this prevents any excessive movement of charged gas lighting source 10 within housing 30, as well as reduces the cross-sectional size of lighting apparatus 1.

Endcaps 32 and 34 not only secure charged gas lighting source 10 within housing 30, preventing any unwanted movement of the assembly, but they also seal open ends 30A and 30B of housing 30, thereby protecting lighting source 10 from moisture and the elements. Similar to housing base 50 and cover member 52, open ends 30A and 30B of housing 30 are slidingly received within endcaps 32 and 34, substantially overlapping at each end for preventing electricity from arcing through the seams created at the ends of the housing. For instance, endcaps 32 and 34 and open ends 30A and 30B could overlap by at least 1–2 inches (depending on the voltage) as an added measure of safety (i.e., in addition to electrical connections 20 and 22 being secured within housing 30 at least 1–2 inches from openings 30A and 30B).

In particular, endcap 32 is solid in construction thereby sealing end 30B. Preferably, electrical power cords 24 and 26 pass through the ends of housing 30. Alternatively, power cords 24 and 26 can pass through the back, front, sides, or any other part of housing 30. For example, referring to FIGS. 1 and 3, endcap 34 can be provided with apertures 35 and 36 through which pass electrical power cords 24 and 26. Apertures 35 and 36 can be designed to receive therethrough electric power cords 24 and 26 in a fluid-tight manner if so desired. Endcaps 32 and 34 are removably secured to housing 30 by a nut 37 and bolt 39 assembly, or any other means known in the art.

Referring again to FIG. 1, charged gas lighting apparatus 1 is provided with a securing means for securing it in place to, for example, an interior or exterior wall of a building. One embodiment of such a securing means includes extensions 38 and 40 with holes 42 and 44 for receiving screws or nails therethrough. Extensions 38 and 40 can be part of endcaps 32 and 34 (FIGS. 1 and 3) or part of housing 30 (not shown). Alternatively, hook and loop material may be used to secure charged gas lighting apparatus 1 in place. Each of these securing means permits a group of charged gas lighting apparatuses 1 to be arranged in any pattern or design, then removed and rearranged in a different design, or reused at different locations. Therefore, charged gas lighting apparatus 1 is a replacement for the non-reusable "exposed neon" glass tubes which are used.

It is often desirable to place two or more lighting apparatuses adjacent to one another, either in longitudinal alignment or angled with respect to one another, in order to give the appearance of one continuous lineal lighting source. In this arrangement, it is preferable to pass the power cords directly between the housings. In one embodiment, this is accomplished by removing the endcaps from each housing and placing the housings adjacent to one another in longitudinal alignment. When this is done, however, a need arises for protecting the adjacent housings from the ingress of precipitation or the outside elements.

Figure 6:
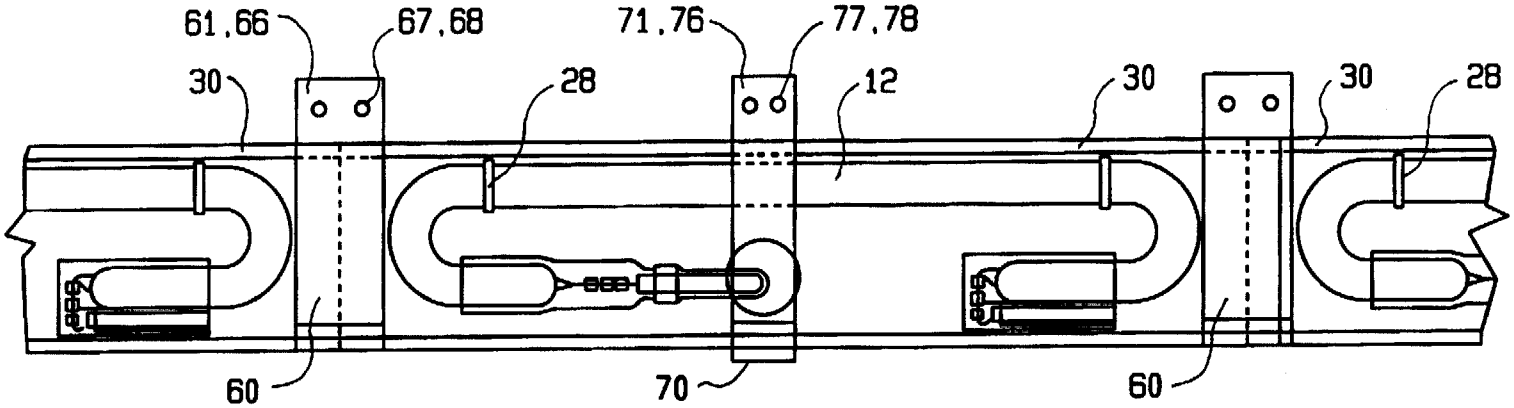
FIG. 6 is an overall perspective view showing several of the charged gas lighting apparatuses of the present invention arranged adjacently to one another.

Referring to FIGS. 6 and 7, successive charged gas lighting apparatuses 1 without facing endcaps 32 and 34 are placed end-to-end, thereby creating a continuous opening for passing power cords 24 and 26 directly between two housings. Connecting bracket 60 connects the two housings, and can be made to substantially seal the seam or opening between open ends of successive housings 30 from the ingress of precipitation or the outside elements. Similarly, if two successive charged gas lighting apparatuses 1 are arranged end-to-end but angled with respect to one another, such as at a corner, an angled embodiment (not shown) of connecting bracket 60 can be used to connect substantially seal the adjacent open ends of the housings 30. Alternatively, charged gas lighting apparatus 1 (including glass tube 12 and housing 30) can be formed into an angled section (not shown); such as, a 90° elbow section for continuous lighting around a corner.

Figure 8:
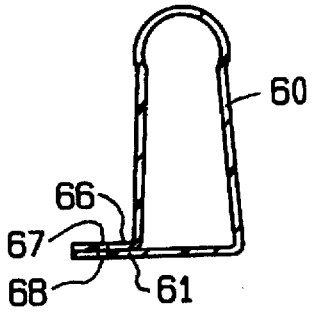
FIG. 8 is a cross-sectional view of the connecting bracket of the charged gas lighting apparatus of the present invention.

Referring to FIG. 8, connecting bracket 60 is P-shaped, and is formed by heat-forming a flat plastic strip into the desired P-shape. Alternatively, the P-shaped can be formed by extrusion or other means known in the art. Connecting bracket 60 has a substantially identical axial cross-sectional shape as housing 30 except bracket 60 is dimensionally adapted to closely and slidingly receive therein the cross-sectional perimeter of housing 30. For instance, the fit between connecting bracket 60 and housing 30 can be close enough to minimize, reduce, or eliminate the entrance of water into housing 30. Connecting bracket 60 may include extensions 61 and 66 with holes 67 and 68 for receiving therethrough a bolt, screw, nail or any other mounting means known in the art, although it is not necessary if other mounting means are used. Holes 67 and 68 can be formed by drilling, punching, or other means known in the art. Bracket 60 allows for one or more charged gas lighting apparatuses 1 to be arranged in any pattern or design, then removed and rearranged in a different design, or remounted at a different location without any wear and tear on housing 30. Also, connecting bracket 60 allows for multiple charged gas lighting apparatuses 1 to be placed end-to-end so that no endcaps 32 and 34 are needed; for example, a continuous light source encircling the entire outer circumference of a building.

It is also contemplated that connecting bracket 60 and housing 30 can be formed as a single unit; i.e., as one piece. Referring back to FIG. 1, housing 30 can be fabricated with end 30A dimensioned larger than end 30B, whereby end 30A of one housing can be slideably and closely received within end 30B of a second housing, thereby adequately connecting or sealing two successive open-ended housings placed end-to-end.

Charged gas lighting instruments can be mounted, for example, to the interior or exterior wall of a building with a support bracket. A support bracket can be formed as an integral part of the housing or housing endcaps. Support brackets are designed to support all or a portion of the length of a lighting instrument of a particular length. However, support brackets attached in fixed relation to the housing do not allow the light apparatus to be supported at different locations along its length, if so needed. For instance, there are often obstacles which prevent the support bracket from being attached at a particular location. Thus, a need exists for an adjustable method of supporting lighting instruments which is independent of the endcaps and the housing.

Figure 9:
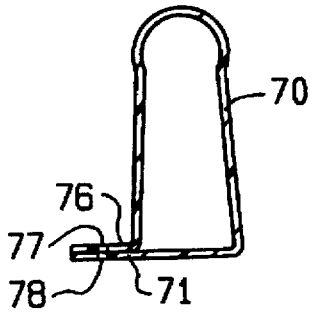
FIG. 9 is a cross-sectional view of the support bracket of the charged gas lighting apparatus of the present invention.

Referring to FIGS. 6 and 9, support bracket 70 provides a releasable and movable means of securing charged gas lighting apparatus 1 in place, for example to an interior or exterior wall. Support bracket 70 is similar to connecting bracket 60 in shape and dimension, but can be shorter in length than connecting bracket 60, although not required. Support bracket 70 is P-shaped, and is preferably formed by heat-forming a flat plastic strip into the desired P-shape. Alternatively, the P-shape can be formed by extrusion or other means known in the art. Support bracket 70 has a substantially identical axial cross-sectional shape as housing 30 except support bracket 70 is dimensionally adapted to closely and slidingly receive therein the cross-sectional perimeter of housing 30. Support bracket 70 includes extensions 71 and 76 with holes 77 and 78 for receiving therethrough a bolt, screw, nail, or any other means known in the art for securing charged gas lighting apparatus 1 to an interior or exterior wall, or other mounting surface. Holes 77 and 78 can be formed by drilling, punching, or other means known in the art. Holes 77 and 78 are co-linear for receiving a single bolt or screw therethrough, or off-set such that a separate bolt or screw is required for each hole. By off-setting the holes 77 and 78 support bracket 70 can be used to facilitate the installation of charged gas lighting apparatus 1.

For example, at least one bracket 70 can be bolted (or screwed or nailed) through hole 78 to the mounting surface. This permits the installer to then place a charged gas lighting apparatus 1 within bracket 70 which holds the lighting apparatus in place and frees the installer's hands for securing the apparatus to the mounting surface. The installer having both hands free can then safely bolt bracket 70 to the mounting surface through hole 77. This eliminates the dangerous situation where the installer, while on a ladder high above the ground, is forced to hold multiple charged gas lighting apparatuses 1 in place while attempting to secure them to the mounting surface. Support bracket 70 allows for charged gas lighting apparatuses 1 to be arranged in any pattern or design, then removed and rearranged in a different design, or remounted at a different location without any wear and tear on housing 30.

Charged gas lighting instruments are typically manufactured to a standard predetermined length and then transported to the installation location. However, many applications for charged gas lighting arise which will not be sufficiently met using only a combination of standard length, adjacently mounted lighting instruments. This typically occurs when there is a need for a continuous lineal lighting source which is longer or shorter than an exact multiple of the length of a standard lighting instrument. Thus, a need exists for an adjustable-length lighting instrument which can be easily assembled, adjusted, and installed in the field to complete any overall length of continuous lineal lighting source required. This lighting instrument should also meet all UL safety standards disclosed herein.

Figure 14:
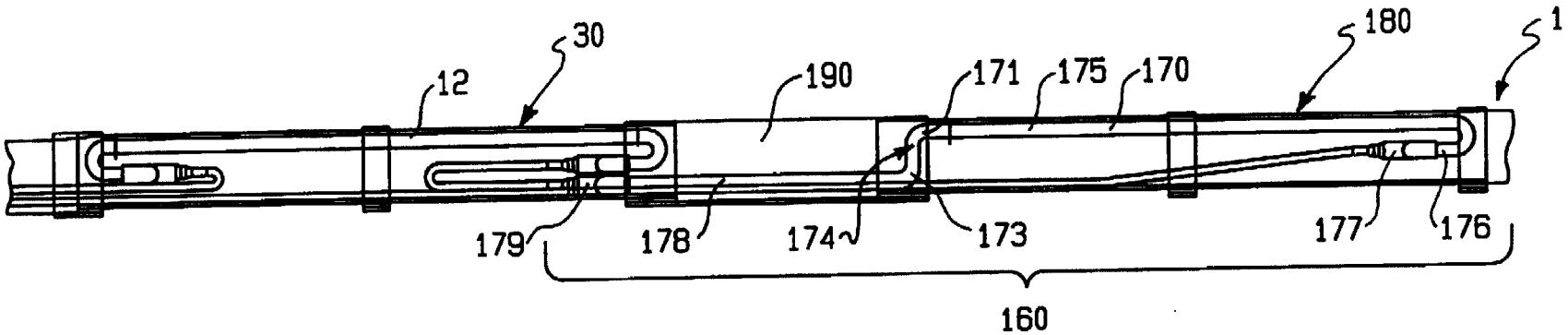
FIG. 14 is a perspective view of the extension tube, extension sleeve, and extension housing of the charged gas lighting apparatus of the present invention in an extended position.
Figure 14A:
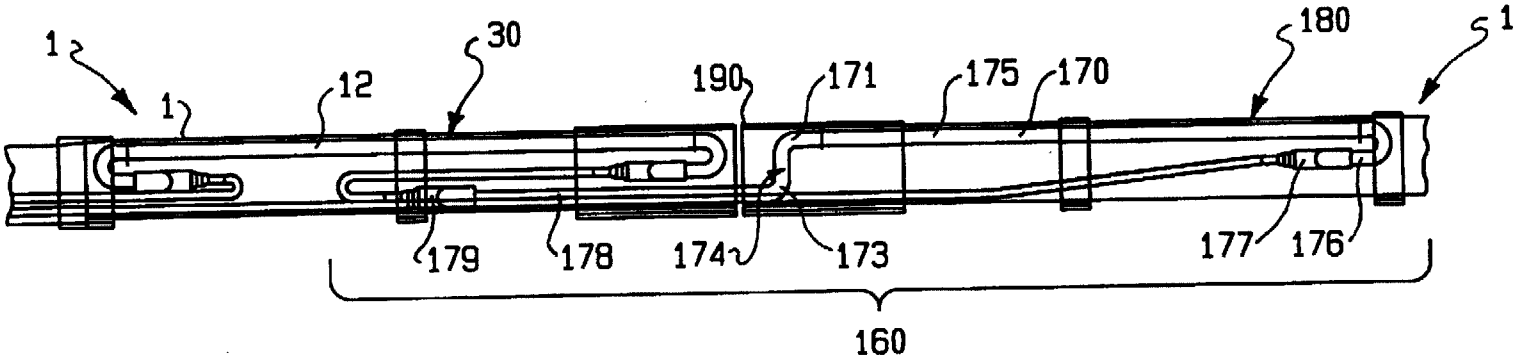
FIG. 14A is a perspective view of the extension tube, extension sleeve, and extension housing of the charged gas lighting apparatus of the present invention in a closed position.

Referring to FIGS. 14 and 14A, an adjustable-length extension assembly 160 which meets UL safety standards is shown. FIG. 14 shows extension assembly 160 in a closed position, and FIG. 14A shows assembly 160 in an open, extended position. Extension assembly 160 is shown in combination with a standard charged gas lighting apparatus 1. Extension assembly 160 is the preferred extension means for extending charged gas lighting apparatus 1 and includes extension tube 170, extension housing 180, and extension sleeve 190. Extension tube 170 is an elongated glass tube containing a light emissive-gas, such as neon, similar to glass tube 12 described above. Extension tube 170 includes two ninety-degree turns 171 and 173, thereby forming an "S"-shaped bend, sometimes known as an off-set bend, or as hereinafter referred to as a step bend 174. Although step bend 174 can be formed at any point along the length of tube 170, it is preferably formed near the longitudinal center of extension tube 170 thereby forming tube section 175 to one side of step bend 174 and tube section 178 to the opposite side of step bend 174. End 176 of tube section 175 is angled approximately 180° to the rear and center of tube 170 (similar to ends 16 and 18 of tube 12 as shown in FIG. 1), and connects to electrical connections 177. Tube section 178 is substantially straight and connects to electrical connections 179. Rear section 178 of extension tube 170 is slidingly received behind glass tube 12 of adjacent charged gas lighting apparatus instrument 1. Extension tube 170 effectively lengthens the apparent length of the glass tube 12. Extension tube 170 may be slid longitudinally as required to create the desired effective length for tube 12.

Extension housing 180 is similar in cross-sectional shape to housing 30, as described above. Extension housing 180 can be cut to any length at the location of installation. As shown in FIG. 14, extension housing 180 is mounted in substantial longitudinal alignment with housing 30 of a standard charged gas lighting apparatus 1. Alternatively, assembly 160 can be mounted at an angle with respect to charged gas lighting apparatus 1 if so desired. In such circumstance, sleeve 190 may be appropriately angled to accommodate the angle without departing from the scope of the invention.

Figure 10:
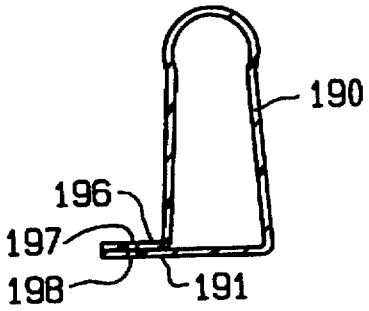
FIG. 10 is a cross-sectional view of the extension sleeve of the charged gas lighting apparatus of the present invention.

Referring to FIG. 10, extension sleeve 190 is dimensioned to slidingly and closely receive therein extension housing 180 at one open end and housing 30 at the other open end. Extension sleeve 190 includes extensions 191 and 196 with holes 197 and 198 (not shown in FIGS. 14 and 14A) for receiving therethrough a bolt, screw, nail, or any other means known in the art for mounting charged gas lighting apparatus 1 to an interior or exterior wall, or other mounting surface. Alternatively, extension sleeve 190 can be provided without mounting means as in FIGS. 14 and 14A. Preferably, extension sleeve 190 is cut to length at the place of installation so that it overlaps the end of extension housing 180 and housing 30 by approximately 1–2 inches, depending on the voltage of the lighting apparatuses, thereby satisfying UL safety standards. Alternatively, extension housing 180 can be combined with extension sleeve 190 to form a one-piece extension unit.

Preferably, housing 30, connecting bracket 60, support bracket 70, extension housing 180, extension sleeve 190, and endcaps 32 and 34 (if needed) are all made of dielectrically sound material, to accommodate the high voltages encountered with charged gas lighting operations.

The foregoing designs all provide a high level of safety to the user or installer in that the possibility of electrical shock is reduced considerably and almost completely eliminated. In addition, the present invention protects fragile glass lighting tubes from breaking or damage, has a small cross-sectional profile, and permits the easy alignment and installation of multiple units in a predetermined arrangement.

Wherein it is apparent that the invention herein disclosed from the various embodiments will provide many improvements, it will be appreciated that numerous modifications and other embodiments may be made by those of ordinary skill in the art and it is intended that the appended claims cover such modifications and embodiments that fall within the spirit and scope of the present invention.

I claim:

1. A lighting apparatus, comprising:

a first elongated tubular housing member having at least one open end;

a second elongated tubular housing member having at least one open end;

a sleeve adapted to receive therein the open ends of the first and second housing members;

an adjustable-length charged gas lighting source configured and dimensioned to be received within said first and second tubular housing members, the adjustable-length lighting source comprising:

at least one conducting element for connecting said adjustable-length lighting source to a power source;

a first lighting source configured and dimensioned to be received within the first tubular housing member; and a second lighting source received within the second tubular housing member and extending within the first tubular housing member, at least a portion of the second lighting source overlapping the first lighting source in a first configuration and configured and dimensioned to adjust the apparent length of the adjustable-length lighting source by reducing said overlapping in a second configuration.

2. The apparatus of claim 1, wherein said second lighting source comprises:

at least one elongated glass tube having sealed ends and containing a light emissive gas, a first end being bent back along itself at one point such that said first end is secured within said second tubular housing member, and said glass tube being bent into an offset along its length.

3. The apparatus according to claim 1, wherein said first and second housing members and said sleeve are formed of a plastic material.

4. The apparatus according to claim 1, wherein said second housing member and said sleeve are one-piece.

5. The apparatus according to claim 1, wherein said sleeve is tubular.

6. The apparatus according to claim 5, wherein said sleeve is angled with respect to the longitudinal axis of said first and second housing members.

7. The apparatus according to claim 5, wherein said sleeve seals the open ends of said first and second housing members.

8. The lighting apparatus of claim 1, further comprising means for mounting said first and second housing members, said mounting means being adjustable with respect to each of said housing members.

9. The apparatus according to claim 8, wherein said mounting means comprises said sleeve, said sleeve having holes therein for receiving holding members therethrough.

10. The apparatus according to claim 9, wherein said holes are off-set with respect to one another.

11. A lighting apparatus, comprising:

a first elongated tubular housing member having at least one open end;

a second elongated tubular housing member having at least one open end;

a sleeve adapted to receive therein the open ends of the first and second housing members;

an adjustable-length charged gas lighting source configured and dimensioned to be received within said first and second tubular housing members; the adjustable-length lighting source comprising:

at least one conducting element for connecting said adjustable-length lighting source to a power source;

a first lighting source configured and dimensioned to be received within the first tubular housing member; and a second lighting source received within the second tubular housing member and extending within the first tubular housing member, at least a portion of the second lighting source overlapping the first lighting source in a first configuration and configured and dimensioned to adjust the apparent length of the adjustable-length lighting source by reducing said overlapping in a second configuration; and wherein grooves are formed on said first and second housing members for diffusing light emitted from said housing members to conceal said at least one conducting element from view.

12. A lighting apparatus, comprising:

a first elongated tubular housing member having at least one open end;

a second elongated tubular housing member having at least one open and configured and dimensioned for sliding engagement with respect to said first tubular housing member;

an adjustable-length charged gas lighting source configured and dimensioned to be received within said first and second tubular housing members, the adjustable-length lighting source comprising:

at least one conducting element for connecting said adjustable-length lighting source to a power source;

a first lighting source configured and dimensioned to be received within the first tubular housing member; and a second lighting source received within the second tubular housing member and extending within the first tubular housing member, at least a portion of the second lighting source overlapping the first lighting source in a first configuration and configured and dimensioned to adjust the apparent length of the adjustable-length lighting source by reducing said overlapping in a second configuration.

* * * * *